United States Patent [19]

Mamvriisky et al.

[11] 4,103,351

[45] Jul. 25, 1978

[54] APPARATUS FOR CONTROLLING THE DENSITY OF A PLUGGING FLUID

[76] Inventors: Alexandr Sergeevich Mamvriisky, prospekt Revoljutsii, 26/36, kv. 7; Alexandr Mikhailovich Lapchenko, ulitsa Moskovskaya, 68, both of Grozny, U.S.S.R.

[21] Appl. No.: 777,071

[22] Filed: Mar. 14, 1977

Related U.S. Application Data

[62] Division of Ser. No. 598,550, Jul. 24, 1975, Pat. No. 4,027,860.

[51] Int. Cl.[2] ..... B01F 15/02

[52] U.S. Cl. ..... 366/30; 366/165; 366/167

[58] Field of Search ..... 259/153, 145, 148, 149, 259/161, 162, 164, 165, 168, 2, 4 R, 18; 366/30, 165, 167

[56] References Cited

U.S. PATENT DOCUMENTS

| | | | |
|---|---|---|---|
| 1,649,062 | 11/1927 | Halliburton | 259/151 |
| 3,231,245 | 1/1966 | Harvey | 259/153 |
| 3,338,560 | 8/1967 | Katzer | 259/18 |
| 3,489,394 | 1/1970 | Stogner | 259/153 |

*Primary Examiner*—Robert W. Jenkins

*Attorney, Agent, or Firm*—Lackenbach, Lilling & Siegel

[57] ABSTRACT

An apparatus for controlling the density of a plugging fluid including means for shaping the jet of the carrier liquid into a flat jet and rotating the jet about its longitudinal axis thereof in the area of mixing a dry cementation material.

8 Claims, 7 Drawing Figures

APPARATUS FOR CONTROLLING THE DENSITY OF A PLUGGING FLUID

This is a division of application Ser. No. 598,550, filed on July 24, 1975, now U.S. Pat. No. 4,027,860, granted June 7, 1977.

The present invention relates to the technique of cementing oil and gas wells and, more particularly, it relates to the apparatus employed for preparation of plugging fluids.

Cementing of oil and gas wells is among the most important operations in construction of such wells, and the quality of cementing deep wells depends to a great extent upon the quality of the plugging fluid pumped into the well. Of paramount importance is the problem of maintaining the predetermined density of the fluid throughout the entire plugging operation, for even slight deviations from the predetermined density might cause a serious breakdown.

There is known a stepwise method of controlling the density of a plugging fluid by varying the flow rate of the carrier liquid by aid of positioning a nozzle of a required by rotation of a magazine, by replacing a connection member, or else by varying the pressure of the liquid being pumped (see, for example, "Apparatus and Processes of Well Cementation" by S. V. Logvinenko, NEDRA Publishers, Moscow, 1968).

Preparation of a plugging fluid by this known method and controlling the density of this fluid are performed in the following sequence:

feeding a dry cementing mixture through a funnel into a mixing chamber;

pumping a carrier liquid through a replaceable nozzle into the mixing chamber;

mixing the dry cementing mixture with the carrier liquid;

directing the prepared fluid into the discharge conduit.

Among the disadvantages of this known method are:

impossibility of steplessly controlling the density of the prepared fluid in the course of the plugging process;

a considerable waste of the fluid directed to waste as not conforming to the density requirements at the initial stage of the plugging operation;

the prolonged period of coming up to the duty of preparation of the plugging fluid of the required density.

There is known another method of controlling the density of a plugging fluid, wherein the density of the already prepared plugging fluid is varied by feeding the carrier liquid via a bypass line bypassing the mixer into the discharge conduit to thin the prepared plugging fluid (see the same book "Apparatus and Processes of Well Cementation" by S. V. Logvinenko, NEDRA Publishers, 1965). This method is performed, as follows:

feeding the dry cementing mixture into the mixing chamber;

pumping the carrier liquid into the mixing chamber;

mixing the dry cementing mixture with the liquid in the mixing chamber;

directing the prepared plugging fluid into the discharge conduit;

thinning the plugging fluid with the carrier liquid to the required density in the discharge conduit.

However, the foregoing method is also not free from disadvantages:

the density of the plugging fluid cannot be controlled to increase this density, the controlling technique providing solely for reducing this density;

the prolonged time of coming up to the operation duty;

considerable waste of the fluid.

Preparation of plugging fluids is effected in known apparatus of the hydraulic mixer type.

Thus, there is known a hydraulic mixer comprising a mixing chamber having secured thereto a discharge conduit and a tubular elbow bend having a uniformly flaring conical jet outlet and a replaceable nozzle with a cylindrical bore, which can be screwed into the elbow bend housing after having unscrewed and removed the plug (see "Cement Mixing Unit 1AS-20" by N. G. Kurbanov, in "Machines and Oil Equipment" Manual, vol. 6, Appendix 1, VNIIOENG, Moscow, 1966).

There is also known a hydraulic mixer comprising a discharge conduit secured to the mixing chamber, the opposite side of the mixing chamber supporting an elbow bend. The elbow bend has mounted therein a rotatable magazine having a flange through which a plurality of bores of different diameters are made. By aligning the bores of the selected diameters with the jet nozzle, it is possible to vary the capacity of the apparatus and also the density of the fluid step-wise without interrupting the plugging process.

To rotate the magazine, first, a handle is operated to release a ball-type retaining device and then the handle is rotated to align the selected bore of the magazine with the nozzle, whereafter the handle is operated once again to retain the magazine (see "Apparatus and Processes of Well Cementation" by S. V. Logvinenko, NEDRA Publishers, Moscow, 1965 — Appendix No 2, p. 10).

Outside the USSR there is relatively widely utilized the hydraulic mixer marketed by the Halliburton company.

This mixer includes a conical hopper or funnel secured to a mixing chamber to which there is also secured the discharge conduit. On the opposite side of the mixing chamber there is situated a device for varying the cross-sectional area of the jet nozzle, including a ground-in plug with three bores of different cross-sectional areas and one great bore which acts as the inlet of the carrier liquid and communicates with the pressure line. The bores can be changed over in the course of the plugging operation by rotating the plug (see "Composite Catalog of Oil Field Equipment and Services", USA, V-II, 1966–1967).

A disadvantage of the foregoing known mixers is the impossibility of controlling the density of the plugging fluid at a permanent preset flow rate of the carrier liquid.

Another disadvantage of the known mixers is the prolonged time of coming up to the required density of the plugging fluid, which involves considerable waste of the fluid.

It is an object of the present invention to create an apparatus for performing the method of controlling the density of a plugging fluid, which should be of a simple structure, inexpensive in manufacture and in maintenance.

It is a further object of the present invention to create an apparatus which should be capable of infinite adjustment of the mixing duty without re-assembling and structural modifications.

And, finally, it is an object of the present invention to create an apparatus which should be provided with a dial calibrated in the units of density of a plugging fluid and which should eliminate the waste of time on selection of a required operational duty.

According to one of the embodiments of the present invention, there is proposed an apparatus for controlling the density of a plugging fluid by the herein disclosed method in a hydraulic mixer comprising a feed hopper for a dry cementing material, a mixing chamber having mounted thereon along a common axis a discharge conduit and a unit for charging the carrier liquid through a jet nozzle, the apparatus being characterized in that the said charging unit has mounted therein a rotatable sleeve receiving therein a nozzle member with a slot-shaped outlet, there being provided means for rotating the sleeve jointly with the nozzle member about their common longitudinal axis.

This feature provides for rotating the flat jet of the carrier liquid in the apparatus without discontinuing the plugging fluid preparation process.

According to a further embodiment of the invention, the disclosed apparatus is characterized in that the outlet of the nozzle member is shaped as a rectangular slot, the ratio of the sides defining the outlet being from 1:2 to 1:15.

This structural feature enables to prepare a plugging fluid with any required density from; a variety of cementing materials and compositions.

According to a still further embodiment of the present invention, the apparatus is characterized in that the rotatable sleeve has the area of its mounting in the carrier liquid charging unit positively sealed, the sleeve having a through-going radial groove in the walls thereof, whereas the nozzle member has a flange with parallel chamfer portions, receivable in said radial groove and made to abut against the shoulder of the sleeve, whereby the nozzle member is retained against rotation in the sleeve, the ports in the wall of the sleeve, defined by the groove, permanently communicating with the passage through which the carrier liquid is fed.

The above structural feature enables to use the ports in the sleeve for mounting therein the nozzle member and for feeding the carrier liquid therethrough, as well as to effect rotation of the nozzle member jointly with the sleeve.

According to a still further embodiment of the invention, the apparatus is characterized in that the said rotatable sleeve is received in the elbow bend of the charging unit, the tail portion of the sleeve and the corresponding portion of the elbow bend having made therein matching grooves adapted to accommodate a fork-shaped resilient clip retaining the sleeve against axial displacement.

This structural feature enables to replace a nozzle member in but a few seconds.

And, finally, according to a further embodiment of the present invention, the apparatus is characterized in that the tail portion of the sleeve, projecting outside the elbow bend, supports thereon a sleeve rotating assembly including a circular calubrated dial.

The above structural feature enables to attain the required density of the plugging fluid at the very beginning of the fluid preparation process by pre-adjusting the nozzle member to a corresponding angular position, in accordance with the properties of the cementing material.

Other objects and advantages of the present invention will become apparent from the following detailed description of the embodiments of the disclosed apparatus and of the essence of the disclosed method, with reference being had to the accompanying drawings, wherein.

The technique of controlling the density of a plugging fluid by the herein disclosed method includes the following operations, performed in a sequence to be described hereinbelow.

Figure 1:
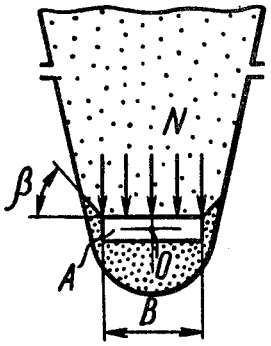
FIG. 1 illustrates schematically the setting of the apparatus, with the area of taking-up the dry cementing material being shown at the maximum, whereby the density of the plugging fluid is likewise maximal.
Figure 2:
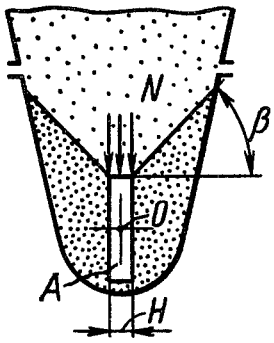
FIG. 2 illustrates the position of the jet with the area of taking-up the cementing material minimum, and the density of the plugging fluid is minimal.
Figure 3:
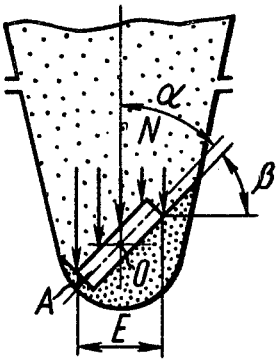
FIG. 3 illustrates the position of the jet in the apparatus corresponding to an intermediate area of taking-up the cementing material, whereby an intermediate value of the density is attained.

A dry cementing mixture "N" (FIGS. 1 to 3) is fed from a bin into a feed hopper, wherefrom it is supplied into the mixing chamber. A carrier liquid "A" is charged through a nozzle member also into the mixing chamber, this carrier liquid "A" being pre-shaped into a flat jet by aid of a rectangular slot-shaped outlet in the nozzle member. With the pressure P being from 10 to 20 $kgf/cm^2$ the jet of the liquid substantially retains its shape without dispersing within the confines of the mixing chamber of the hydraulic mixer. To control the density of the plugging fluid, the flat jet is rotated about its symmetry axis relative to the stream of the dry cementing material.

With the flat jet being thus rotated, the surface area of its projection upon the plane perpendicular to the stream of the dry cementing material is varied, which means that the area over which the jet engages and takes up the material is varied, as well as the quantity of the material "N" taken up by the jet.

Thus, with the flat jet being hotizontal (FIG. 1) and the greater side "B" of the jet being perpendicular to the stream of the dry material "N", the quantity of the material taken by the jet is at the maximum, whereby the density of the plugging fluid is maximal.

The body of the cementing material within the space of the mixing chamber, underlying the jet, and the portions of the material defined by the angle "$\beta$" of natural repose remain immobile.

With the jet being positioned vertically (FIG. 2) and the smaller side "H" of the jet being perpendicular to the stream of the cementing material "N", the quantity of the dry mixture being taken up by the jet is at the minimum, and the density of the plugging fluid obtained is likewise minimal. In the intermediate positions (FIG. 3) the area of taking up the dry mixture is defined by the horizontal projection "E" of the jet.

Thus, by varying the surface area of the projection of the jet of the carrier liquid "A" onto the plane perpendicular to the stream of the dry cementing material "N" by means of rotation of the jet about its symmetry axis, without any replacement of the nozzle and with the flow rate of the liquid being permanent, the quantity of the dry mixture taken up by the jet and, consequently, the value of the density of the plugging fluid are varied between the minimum and the maximum.

Figure 4:
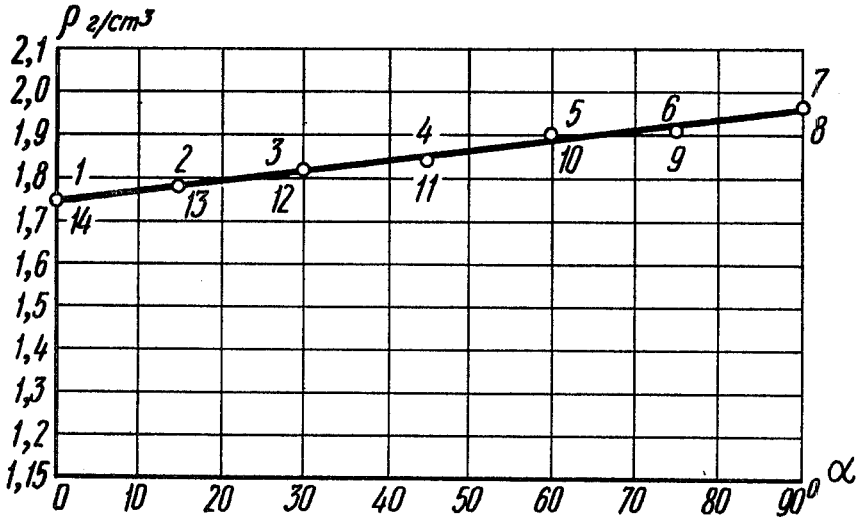
FIG. 4 illustrates graphically the variation of the density of the plugging fluid, depending on the angle of rotation of the plane of the flat jet of the carrier liquid.

The variation of the density of the plugging fluid, depending on the angle of rotation of the plane of the carrier liquid jet "A" relative to the stream of the dry material "N" is graphically illustrated in FIG. 4.

The curve in the drawing is based on the data obtained at preparation of plugging fluids with portland cement. From the diagram in FIG. 4 it can be seen that the density of the plugging fluid varies linearly with the flat jet being rotated relative to the stream of the dry material between 0° and 90° (i.e. the curve is practically a straight line), between 1.74 g/cm$^3$ to 1.96 g/cm$^3$ (refer to points 1, 2, 3, 4, 5, 6, 7), the fluctuations of the density of the plugging fluid at any angular position of the nozzle member being within ±0.02 g/cm$^3$.

Portland cement is utilized for preparation of plugging fluids in a density range from 1.78 to 1.83 g/cm$^3$.

In the above example the controllable density range is from 1.74 to 1.96 g/cm$^3$, i.e. the range of the densities of the plugging fluid to be prepared with portland cement is positively overlapped at both ends.

Thus, at cementation of a well the density of the plugging fluid was to be maintained, according to the outcome of a laboratory analysis, within a range from 1.78 to 1.83 g/cm$^3$. There was mounted in the hydraulic mixer a slot-shaped nozzle member with the flow passage area equivalent to a round outlet with a 12 mm diameter, the slot being positioned vertically.

The carrier liquid was charged at 15 kgf/cm$^2$, the cementing material was fed to the mixer, and the density of the plugging fluid was 1.73 g/cm$^3$.

Following the rotation of the nozzle member through 30° from the vertical position, with the same pressure of the carrier liquid, the density of the plugging fluid became 1.80 g/cm$^3$.

The time required for coming up to the required density of the fluid was 23 seconds.

At this operating duty 20 tons of portland cement were consumed. Throughout the entire plugging operation 40 check-up measurements of the density of the fluid were made. Every measurement shown the density of the fluid equalling 1.80 g/cm$^3$.

Figure 5:
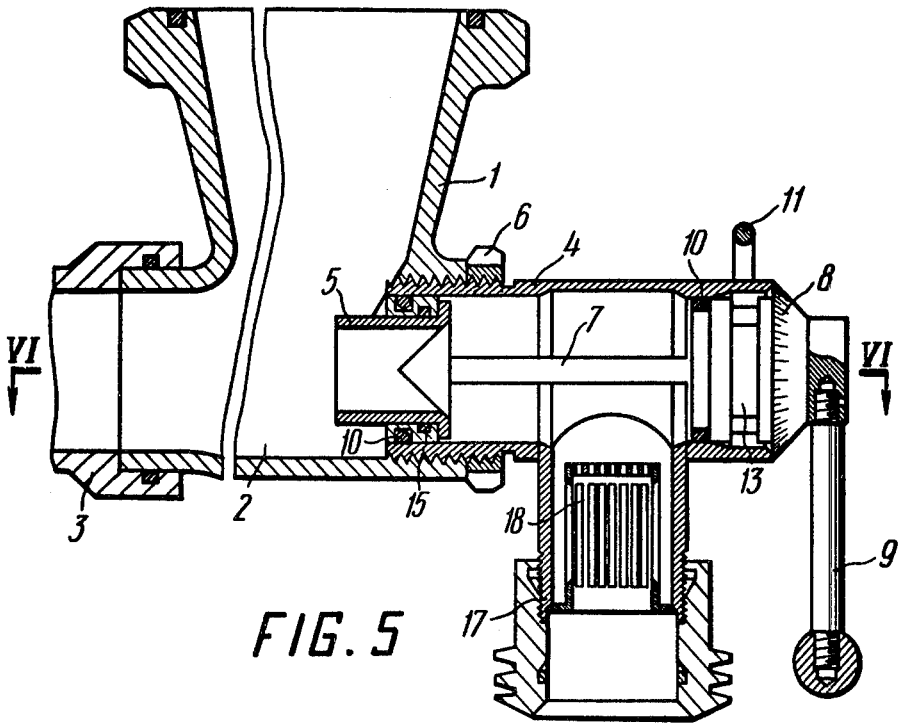
FIG. 5 is a cross sectional view of the disclosed apparatus.
Figure 6:
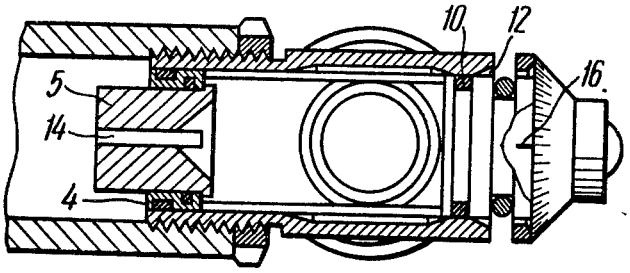
FIG. 6 is a cross sectional view taken along the line VI—VI in FIG. 5.

The herein disclosed apparatus includes a feed hopper or funnel 1 (FIG. 5) attached to a mixing chamber 2. The mixing chamber 2 has also secured thereto a discharge conduit 3. In opposition to the discharge conduit 3 and axially aligned therewith there is mounted a liquid charging unit including an elbow bend 4 and a nozzle member 5. The elbow bend 4 is threaded into the housing of the mixing chamber 2 and secured with a lock nut 6. The internal counterbore of the elbow bend 4 receives therein a rotatable sleeve 7 (FIG. 6) with a dial 8 calibrated to read the angles of rotation of the sleeve, as well as the values of the density of the plugging fluid. A handle 9 is attached to the sleeve 7 to effect its angular adjustment.

Figure 7:
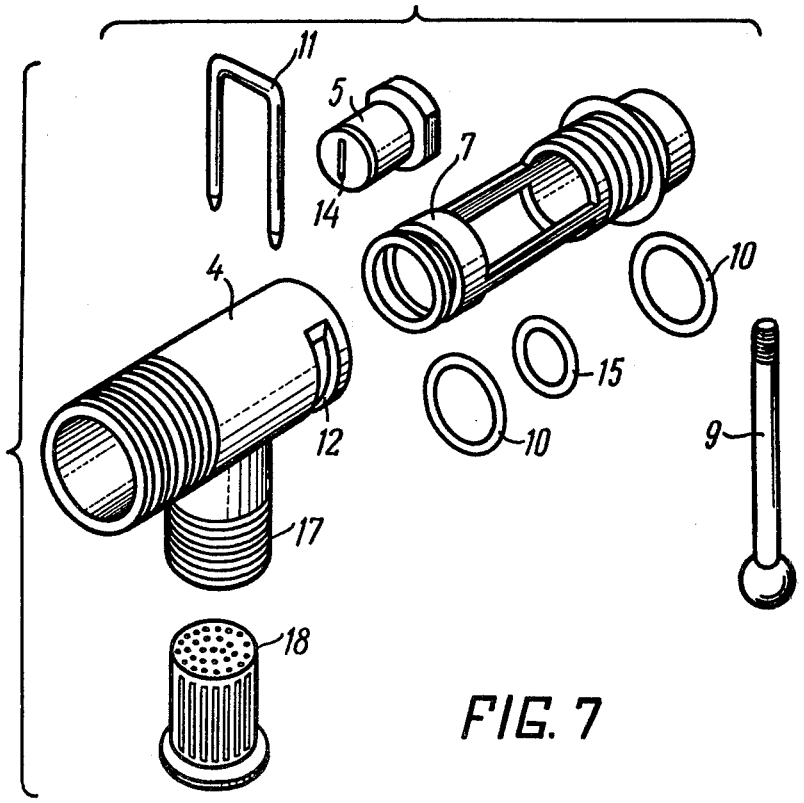
FIG. 7 is an exploded view of the carrier liquid charging unit with the nozzle member.

The cylindrical surfaces of the sleeve 7 are sealed in the counterbore of the elbow bend 4 with suitably rubber seal rings 10. The position of the sleeve 7 in the elbow bend 4 is fixed with a resilient insertable clip 11 (FIG. 7) receivable in the slots 12 of the elbow bend 4 and in an annular groove 13 of the sleeve 7, the clip 11 permitting rotation of the sleeve. The nozzle member 5 with an outlet shaped as a slot 14 is inserted through a port in the wall of the sleeve 7 and then made to abut by its flange against the corresponding shoulder of the sleeve. The cylindrical surface of the nozzle member 5 is suitably sealed by a rubber seal ring 15 accommodated in an internal annular groove of the sleeve 7. The sleeve 7 in the assembled state is rotatable jointly with the nozzle member 5 through required angles by means of the handle 9, the angular adjustment being read against a pointer mark 16 on the elbow bend 4.

The connection piece 4 of the elbow bend 17 is equipped with a filter 18 through which the carrier liquid is forced into the internal space of the sleeve 7 to issue from the slot-shaped outlet 14 of the nozzle member 5.

The herein disclosed apparatus operates, as follows.

The carrier liquid is forced at a predetermined pressure through the connection 17 and the slot 14 of the nozzle member 5, wherefrom it issues in a substantially flat jet. At the initial stage of the process the nozzle 5 with the slot 14 and the jet are positioned horizontally. With the required pressure attained, a dry cementing material is fed via the hopper 1 into the housing of the mixing chamber 2. The dry material is taken up by the jet to mix with the carrier liquid in the mixing chamber and to be discharged via the discharge conduit 3.

Depending on the deviation of the density of the fluid from the required value, the sleeve 7 is rotated jointly with the nozzle member 5, and, consequently, with the liquid jet issuing therefrom through a corresponding angle of which the value can be found for any cementing mixture in a Table appended to the hydraulic mixer.

In the present disclosure the invention has been described in connection with preparation of plugging or cementing fluids, since in the course of preparation of such fluids it is of paramount importance to maintain the required value of the density. However, those component in the art can clearly comprehend that the herein disclosed method and apparatus can be successfully utilized at preparation of flushing, construction and other liquids and mortars, as well as in other techniques where it is essential to infinitely control the ratio of liquid and solid components.

What we claim is:

1. An hydraulic mixing apparatus for the preparation of a fluid, such as a plugging fluid, comprising a feed hopper for a dry cementing material, a unit for charging a carrier liquid and a mixing chamber, wherein the outlet of the charging unit is positioned on a common axis with the inlet of a discharge conduit; said charging unit including a rotatable sleeve sealingly mounted in the charging unit, a nozzle member, having a slot-shaped outlet, adapted to be accommodated within said sleeve, and means for rotating said sleeve jointly with said nozzle member about the common longitudinal axis thereof.

2. An apparatus as claimed in claim 1, wherein the outlet of said nozzle member is shaped a slot of a rectangular shape, the ratio of the sides defining the flow passage of said slot being from 1:2 to 1:15.

3. An apparatus as claimed in claim 1, wherein said rotatable sleeve is accommodated within an elbow bend of said charging unit, the tail portion of the sleeve and the corresponding portion of said elbow bend having matching slots adapted to receive therein an insertable resilient clip fixedly retaining said sleeve against axial displacement.

4. An apparatus as claimed in claim 3, wherein the tail portion of said sleeve, projecting from said elbow bend, supports thereon a sleeve rotating assembly including a circular calibrated dial.

5. An apparatus as claimed in any one of the claim 1, wherein the tail portion of said sleeve, projecting from said elbow bend, supports thereon a sleeve rotating assembly including a circular calibrated dial.

6. An hydraulic mixing apparatus for the preparation of a fluid, such as a plugging fluid, comprising a feed hopper for a dry cementing material, a unit for charging a carrier liquid and a mixing chamber; wherein the outlet of the charging unit is axially aligned with the inlet of a discharge conduit; said charging unit including a rotatable sleeve sealingly mounted in the charging unit, a nozzle member, having a slot-shaped outlet, adapted to be accommodated within said sleeve, and means for rotating said sleeve jointly with said nozzle member about the common longitudinal axis thereof; said rotatable sleeve, being sealed along the area of its mounting in the carrier liquid charging unit, and having a radial slot in the walls thereof, said nozzle member having a flange with parallel portions adapted to be inserted through said radial slot and displaced to abut against the shoulder of said sleeve, whereby rotation of said nozzle member in said sleeve is prevented, and the ports in the wall of said sleeve, defined by said radial slot, being in permanent communication with a conduit through which the carrier liquid is fed into said unit.

7. An apparatus as claimed in claim 6, wherein said rotatable sleeve is accommodated within an elbow bend of said charging unit, the tail portion of the sleeve and the corresponding portion of said elbow bend having matching slots adapted to receive therein an insertable resilient clip fixedly retaining said sleeve against axial displacement.

8. An apparatus as claimed in claim 6, wherein the tail portion of said sleeve, projecting from elbow bend, supports thereon a sleeve rotating assembly including a circular calibrated dial.

* * * * *